United States Patent [19]

Nagarajan et al.

[11] Patent Number: 4,891,149

[45] Date of Patent: Jan. 2, 1990

[54] COMPOSITIONS CONTAINING LIME SOAP DISPERSING POLYMERS AND THEIR USE

[75] Inventors: Madukkarai K. Nagarajan, Avon Lake; William R. Masler, III, Hinckley, both of Ohio

[73] Assignee: The BFGoodrich Company, Akron, Ohio

[21] Appl. No.: 822,163

[22] Filed: Jan. 24, 1986

Related U.S. Application Data

[63] Continuation-in-part of Ser. No. 536,478, Sep. 28, 1983, abandoned.

[51] Int. Cl.[4] ..... C11D 1/83; C11D 3/37; C11D 9/10

[52] U.S. Cl. ..... 252/110; 252/117; 252/132; 252/134; 252/527; 252/546; 252/174.24; 252/DIG. 2; 252/DIG. 14; 252/DIG. 16

[58] Field of Search ..... 252/110, 117, 174.23, 252/174.24, 132, 525, 527, 544, DIG. 2, DIG. 15

[56] References Cited

U.S. PATENT DOCUMENTS

| | | | |
|---|---|---|---|
| 3,130,166 | 4/1964 | Schwalley | 252/110 |
| 3,275,561 | 9/1966 | Pye et al. | 252/110 |
| 3,449,255 | 6/1969 | Johnston | 252/117 |
| 3,692,704 | 9/1972 | Stamm et al. | 252/525 |
| 4,283,299 | 8/1981 | Becker et al. | 252/90 |
| 4,379,068 | 4/1983 | Couderc | 252/99 |

FOREIGN PATENT DOCUMENTS

| | | |
|---|---|---|
| 80222 | 6/1983 | European Pat. Off. . |
| 2558591 | 7/1977 | Fed. Rep. of Germany . |
| 2558592 | 7/1977 | Fed. Rep. of Germany . |
| 3620 | 2/1972 | Japan . |
| 32725 | 8/1972 | Japan . |
| 1041934 | 9/1966 | United Kingdom . |
| 1073947 | 6/1967 | United Kingdom . |
| 2095276 | 9/1982 | United Kingdom . |

*Primary Examiner*—Prince E. Willis

*Attorney, Agent, or Firm*—George A. Kap; Alan A. Csontos

[57] ABSTRACT

Compositions and method of using such compositions in washing applications which comprise at least one water-soluble organic surfactant selected from anionic and nonionic surfactants and a lime soap dispersant having molecular weight of 20,000 to 100,000 that is a copolymer of acrylic or methacrylic acid and acrylamide itself or a substituted acrylamide, in salt form, the relative ratio of the acid to an acrylamide being 35 to 75% by weight polymerized acrylamide with remainder being polymerized acid.

4 Claims, No Drawings

COMPOSITIONS CONTAINING LIME SOAP DISPERSING POLYMERS AND THEIR USE

This is a continuation-in-part of Ser. No. 536,478 filed Sept. 9, 1983, abandoned.

BACKGROUND OF THE INVENTION

The use of soap as a cleaning agent goes back to the dawn of civilization and has had a long record of safety and efficacy. When used as a detergent, soap has two important drawbacks; its poor solubility in cold water and insolubility in water of the calcium and magnesium salts. In an effort to remove these drawbacks, the detergent industry has shifted away from soap and has adopted various synthetic surfactants as the active ingredients in its detergent compositions.

It is well known that in hart water, insoluble soaps are formed which tend to flocculate to form what is called lime scum or lime soap. This tends to be deposited on either the fabrics which have been washed or on vessels in which washing and rinsing is carried out.

In fabrics, the common laundry soils generally consist of about 40% by weight particulate soil and about 60% by weight of oily soil from human sebum or perspiration. The particulate soil component of the laundry soils is mainly composed of abut 75% clay and silica, and about 20% lime soaps. Since lime soaps are generally not efficiently removed by the surfactant in the detergent composition nor are they sequestered by sodium tripolyphosphate or other similar material, which can also be present in the detergent composition, the net result is the cumulative build-up of lime soap deposits on washed fabrics. This condition leads to gradual "graying-up" of washed fabrics and to rancid odors of the fabrics which comes from enzymatic decay of the unsaturated fatty acid portion of lime soaps.

Lime scum can deposit on vessels in which washing and rinsing is carried out to form what is known as "bath tub ring".

More than thirty years ago, it was discovered that precipitation of lime soap could be prevented through the addition of lime soap dispersing agents to the soap. These formulations, however, contained sodium pyrophosphate, which was found to be deleterious to the environment due to the phenomenon called eutrophication, or simply, excessive algae growth in bodies of water into which the used wash liquor containing phosphate is discharged.

Lime soap or lime scum is essentially insoluble calcium salts of fatty acids which are in the form of large aggregates of about 0.01 to 0.03 cm or 100 to 300 microns in size. Such aggregates are not effectively dispersed by the surfactants commonly used in detergent formulations. When a lime soap dispersant is present in a detergent composition, it breaks down or disperses the large-sized lime soap aggregates to micron or even sub-micron particles resulting in a milky dispersion. Thus, the presence of a lime soap dispersant in a detergent composition permits flushing or rinsing away of the lime soap with the result that deposition of lime scum on fabrics is reduced or eliminated and formation of bath-tub rings can be prevented.

The lime soap dispersants, therefore, function to prevent formation of insoluble lime soaps or prevent such soaps from flocculating so that they can be flushed away with the washing or rinsing water and do not adhere to fabrics or to surfaces of the washing vessels.

U.S. Pat. No. 3,692,704 discloses detergent compositions comprising about 50% detergent and about 50% detergent builder wherein the builder component consists of 60% by weight sodium polyacrylate of Mw 100,000 and 40% by weight of poly (N,N-dicarboxymethyl acrylamide) of Mw 50,000.

SUMMARY OF THE INVENTION

In a preferred embodiment, this invention relates to water-soluble copolymers of acrylic acid and acrylamide used as lime soap dispersants in detergent and soap compositions, and to the method of using such compositions for cleaning fabrics and hard surfaces, and for personal washing. Such compositions can contain or can be free of phosphates.

DETAILED DESCRIPTION OF THE INVENTION

The anionic surfactnnts and soaps do not perform efficiently in medium to hard water, however, the use of the herein-disclosed lime soap dispersants in conjunction therewith leads to improved cleaning and lathering performance under such conditions. Even with the other generic types of surfactants, cleaning performance thereof in water is adversely affected by the presence of water harness ions, such as calcium and magnesium. Hardness of natural waters varies widely from about 10 ppm to about 500 ppm of hardness salts expressed as calcium carbonate. The salts that impart hardness to water are generally water-soluble salts of calcium and magnesium such as chlorides, nitrates, and bicarbonates. Water of medium to high hardness contains 150 ppm and more of hardness salts expressed as calcium carbonate, and generally about 150 to 500 ppm.

The detergent compositions of the present invention can be in the form of liquid solutions, powders, granules, flakes, tablets, and bars. Regardless of form, however, only a small amount of a detergent composition is needed in an aqueous medium to obtain excellent cleaning power. Generally, less than 1% by weight, preferably 0.01 to 0.5%, based on the combined weight of the detergent composition and water, will provide sufficient detergent value for fabric and dish cleaning. For more rigorous applications in washing fabrics and dishes, up to 30%, preferably 5 to 15% of the detergent composition in an aqueous medium can be used. For personal washing, amount of the detergent composition, based on the combined weight of the composition and water, can vary from about 1% to about 10%. Aqueous solutions of the detergent compositions disclosed herein should have pH of 5 to 12.5, preferably 9 to 11. Furthermore, the aqueous solutions of these compositions are effective in a wide range of wash water temperatures. Preferably, wash water temperatures should be in the range of about 45° to 200° F., and especially in the temperature range of about 80° to 160° F.

The compositions disclosed herein can contain phosphates or they can be devoid of phosphates. Suitable phosphates which can be used in such compositions include sodium tripolyphosphates, tetrapotassiuim pyrophosphate, and others.

The detergent compositions disclosed herein include an organic water-soluble surfactant and a polymeric lime soap dispersant selected from copolymers of acrylic acid or a substituted acrylic acid and acrylamide or a substituted acrylamide, and water-soluble salts of such copolymers. The water-soluble salts of the copolymers are selected from alkali metal salts, ammonium salts, and substituted ammonium salts. The organic water-soluble surfactants that can be used to prepare the lime soap dispersing compositions include anionic and nonionic surfactants. Soaps are considered to be anionic surfactants, and many of the preferred compositions disclosed herein contain soap varying in amount of 1 to 80 parts by weight, based on 100 parts of composition, depending on the particular application.

Other materials which may be present in the detergent compositions of the invention herein in minor or major amounts are those components conventionally present in detergent compositions. These include such components as builders, soil suspending agents, anti-redeposition agents such as sodium carboxymethyl cellulose, hydrotropes, corrosion inhibitors, dyes, perfumes, fillers such as sodium sulfate, alkaline buffers such as sodium silicates and carbonates, optical brighteners, bleaches such as perborates, percarbonates, organic and inorganic chlorine releasing agents, bleach activators, enzymes, detergent boosters and solvents, suds boosters, suds depressants, lime soap dispersants other than those disclosed herein, germicides, fungicides, anti-tarnishing agents, cationic surfactants, amphoteric surfactants, zwitterioinic surfactants, fabric softening agents and in the case of liquid compositions, opacifiers and organic solvents. In addition, although any of the conventional well-known detergent builders (phosphate and non-phosphate type) may be employed in the compositions of the present invention at a level of 1 to 80%, the absence thereof does not adversely affect detergent efficiency.

The water-soluble soaps which can be used in the detergent compositions of the invention are the higher fatty acid soaps normally used for washing, for instance the alkali metal, especially sodium or potassium, salts of saturated and unsaturated fatty acids having from 8 to 24, especially 10 to 18 carbon atoms. The soaps can be made by direct saponification of natural oils and fats, such as tallow, palm oil, large, greases, coconut or palm kernel oils and many others, or they can be made by neutralization of fatty acids derived from such oils and fats of from those made synthetically or derived from petroleum and like sources. Soaps from natural oils and fats, or from fatty acids derived from them, will be predominantly straight-chained with an even number of carbon atoms. The synthetic fatty acids or those from petroleum sources can be straight- or branch-chained containing even and odd number of carbon atoms. Preferred soaps are those made from mixtures of tallow, grease, or palm oils to provide the longer chain, e.g., $C_{16-18}$ fatty acid residues and coconut or palm kernel oil to provide shorter chain, e.g., $C_{10-14}$ fatty acid residues.

Examples of anionic organic surfactants are the water soluble salts and alkali metal salts of organic sulfuric reaction products having in their molecular structure an alkyl radical containing about 8 to 22 carbon atoms and a radical selected from sulfonic acid and sulfuric acid ester radicals. Included in the term alkyl is the alkyl portion of higher acyl radicals. Important examples of anionic surfactants are the sodium or potassium alkyl sulfates, especially those obtained by sulfating the higher alcohols of $C_8$ to $C_{18}$ carbon atoms produced by splitting the glycerides of tallow or coconut oil, and sodium or potassium alkyl benzenesulfonates in which the alkyl group contains about 9 to 15 carbon atoms. Other examples of alkali metal alkylbenzene sulfonates are those in which the alkyl radical is a straight or branched chain aliphatic radical containing about 10 to 20 carbon atoms; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol and about 1 to 6 moles of ethylene oxide; sodium or potassium salts of alkylphenol ethylene oxide ether sulfate with about 1 to 10 units of ethylene oxide per molecule and in which the alkyl radicals contain about 9 to 12 carbon atoms; the reaction product of fatty acids esterified with isethionic acid and neutralized with sodium hydroxide where, for example, the fatty acids are derived from coconut oil; sodium or potassium salts of fatty acid amide of a methyl tauride in which the fatty acids, for example, are derived from coconut oil; sulfonates polycarboxylic acids derived from pyrolyzed calcium citrate; and others known in the art.

Nonionic surfactants can be broadly described as compounds which do not ionize but usually acquire hydrophilic characteristics from an oxygenated side chain, such as polyoxyethylene, while the hydrophobic part of the molecule may come from fatty acids, alkyl phenols, fatty alcohols, fatty amide4s or fatty amines. Examples of nonionic surfactants include products formed by condensing one or more alkylene oxides of two to four atoms, such as ethylene oxide or propylene oxide, preferably ethylene oxide alone or with other alkylene oxides, with a relatively hydrophobic compound, such as a fatty alcohol, fatty acid, sterol, a fatty glyceride, a fatty amine, an aryl amine, a fatty mercaptan, tall oil, etc. Nonionic surfactants also include those products produced by condensing one or more relatively lower alkyl alcohol amines such as methanolamine, ethanolamine, propanolamine, etc., with a fatty acid such as lauric acid, palmitic acid, tall oil fatty acid, abietic acid, etc., to product the corresponding amide.

Still other nonionic surfactants include the amine oxides and phosphine oxides and preferably the unsymmetrical trialkylamine oxides and phosphine oxides wherein two of the alkyl groups are lower alkyl groups of 1 to 4 carbon atoms and the third alkyl group is a higher alkyl group of 8 to 18 carbon atoms. Examples of these include dimethyldodecyclamine oxide, dimethyldodecylphosphine oxide, dimethyltetradecyl amine oxide, dimethyltetradecyl phosphine oxide, diethylhexadecylamine oxide, diethylhexadecylphosphine oxide, and the like.

Particularly advantageous nonionic surfactants are condensation products of a hydrophobic compound having at least one active hydrogen atom and a lower alkylene oxide for example, the condensation product of an aliphatic alcohol containing from about eight to about 18 carbon atoms and from about three to about 30 mols of ethylene oxide per mol of the alcohol, or the condensation product of an alkyl phenol containing from about eight to about 18 carbon atoms in the alkyl group and from three to about 30 mols of ethylene oxide per mol of alkyl phenol. Other advantageous nonionic surfactants include condensation products of ethylene oxide with a hydrophobic compound formed by condensing propylene oxide with propylene glycol.

The copolymers contemplated by this invention are copolymers of acrylic or methacrylic acid and an acrylamide defined as follows:

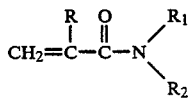

where R is either H or a methyl group; and $R^1$ and $R^2$ are individually selected from hydrogen; alkyl groups of 1 to 3, but preferably 1 to 2 carbon atoms; alkylol groups of 1 to 3 but preferably 1 to 2 carbon atoms; ether groups where the alkylene group contains 1 to 3 carbon atoms and the alkyl group contains 1 to 8 carbon atoms; and alkanone groups where the alkylene group contains 1 to 8 carbon atoms and the alkyl group contains 1 to 4 carbon atoms. Specific examples of suitable acrylamides include acrylamide itself, methacrylamide, and N-substituted acrylamides such as N-methylol acrylamide and methacrylamide, diacetone acrylamide, N-methyl acrylamide, and the like.

Copolymers suitable as lime soap dispersants have molecular weight (Mw) in the range of about 5,000 to 200,000 but preferably up to 100,000 or 20,000 to 100,000. Although the higher molecular weight copolymers can be too viscous and thus make it more difficult to work with, this problem can be minimized, as by diluting the copolymers in a suitable solvent. Suitable lime soap dispersants include copolymers containing 20 to 80% by weight, preferably 35 to 75%, of polymerized monomer units derived from acrylamide or a mixture of acrylamides.

Amount of the copolymers that can be used in the various detergent compositions will depend on the particular composition desired. Set forth below are some examples of a number of different detergent compositions used for various applications wherein the components are given in weight parts.

Bar Soap Composition For Personal Use

| Component | Wt. Parts |
|---|---|
| Alkali Metal Salt of Tallow/Coconut Soap | 60–80 |
| LSD Copolymer | 10–20 |
| Water and Minor Additives | to make 100 parts |

Liquid hand soap can be prepared by diluting with water the bar soap detergent composition to about 5 to 30% solids.

Bar Soap Composition for Laundry Use

| Component | Wt. Parts |
|---|---|
| Alkali Metal Salt of Tallow/Coconut Soap | 40–60 |
| Sodium Silicate | 10–20 |
| LSD Copolymer | 5–20 |
| Water and Minor Additives | to make 100 parts |

Dry Soap Laundry Powder Composition

| Component | Wt. Parts |
|---|---|
| Alkali Metal Salt of Tallow/Coconut Soap | 60–80 |
| LSD Copolymer | 10–20 |
| Sodium Silicate | 10–15 |
| Sodium Carboxymethyl Cellulose | 1–3 |
| Water and Minor Additives | to make 100 parts |

Anionic Laundry Powder Detergent Composition

| Component | Wt. Parts |
|---|---|
| Linear Alkylbenzene Sulfonate (LAS) | 10–25 |
| Sodium Carboxymethyl Cellulose | 1–3 |
| LSD Copolymer | 1–5 |
| Alkaline Builders | 35–85 |
| Water and Minor Additives | to make 100 parts |

Nonionic Laundry Powder Detergent Composition

| Component | Wt. Parts |
|---|---|
| Nonionic Surfactant | 5–15 |
| Alkaline Builders | 40–80 |
| Sodium Carboxymethyl Cellulose | 1–3 |
| LSD Copolymer | 1–5 |
| Water and Minor Additives | to make 100 parts |

Liquid Dishwashing Detergent Composition

| Component | Wt. Parts |
|---|---|
| Anionic and/or Nonionic Surfactant | 20–45 |
| Hydrotrope | 1–10 |
| Mono or Polyhydric Water-Miscible Alcohol | 1–10 |
| LSD Copolymer | 5–15 |
| Water and Minor Additives | to make 100 parts |

Mixed Surfactant Laundry Powder Detergent Composition

| Component | Wt. Parts |
|---|---|
| Anionic and Nonionic Surfactants | 1–10 |
| Soap | 1–20 |
| LSD Copolymer | 1–10 |
| Alkaline Builders | 10–20 |
| Water and Other Additives | to make 100 parts |

Generally speaking, the relative ratio of the water-soluble organic surfactant to the copolymer can vary from 100/1 to 1/2, preferably 15/1 to 1/1. In bar soap compositions for personal use, the ratio of surfactant to copolymer can vary from 8/1 to 4/1; in bar soap compositions for laundry use, the ratio is from 12/1 to 2/1; in dry powder laundry soap compositions, this ratio can vary from 8/1 to 3/1; in anionic laundry detergent compositions, the ratio can vary from 25/1 to 2/1; in nonionic laundry powder detergent compositions, the ratio can vary from 15/1 to 1/1; in liquid dishwashing compositions, the ratio can vary from 10/1 to 1/1; and in mixed surfactant laundry powder compositions, the ratio can vary from 30/1 to 2/1.

It has been discovered that the use of the lime soap dispersing copolymers in detergent compositions can impart certain important attributes in addition to their redispersing function. Such attributes include the following: partial replacement of the surfactant; lower level of perfume required, which is an expensive ingredient; and partial or total replacement of the anti-redeposition agent, such as carboxymethyl cellulose, which is added to prevent graying-up of white fabrics.

The copolymers disclosed herein provide synergistic results in terms of lime soap dispersancy property. This is based on the fact that polyacrylate homopolymers impart only a moderately effective lime soap dispersing property whereas polyacrylamide homopolymers impart little or no lime soap dispersing property. Efficacy of the lime soap dispersing copolymers is critically dependent not only on the relative proportion of acrylic or methacrylic acid to an acrylamide but also on the molecular weight (Mw) of the copolymers themselves.

A large number of copolymers were prepared varying in composition and molecular weight which were then subjected to a lime dispersion test in order to determine their effectiveness to disperse lime scum. This test follows the general procedure described in published literature. The objective of the test is to measure, by visual titration procedure, the minimum amount of a lime soap dispersant needed to completely disperse a given amount of calcium oleate, a lime soap. The result is expressed as lime soap dispersion index (LSDI) which is calculated as follows:

$$LSDI = \frac{\text{grams of calcium oleate}}{\text{(min. grams of } LSD \text{ needed to completely disperse calcium oleate)}}$$

The higher the LSDI, the better is the efficiency of the lime soap dispersant.

The lime soap dispersion test used herein utilizes the following reagents:

(a) sodium oleate solution that is made by dissolving 0.50 g of USP sodium oleate in 100 ml demineralized water with pH adjusted to 10.5 with sodium hydroxide of hydrochloric acid;

(b) hardness solution that is prepared by dissolving 1.9600 g of $CaCl_2 \cdot 2H_2O$ crystals and 1.3553 g of $MgCl_2 \cdot 6H_2O$ crystals in 2000 ml of demineralized water and adjusted to a pH of 10.5. Total hardness is 1000 ppm expressed as calcium carbonate;

(c) LSD polymer solution that is prepared by dissolving 0.25 g of dry polymer in 100 ml of demineralized water and adjusted to pH of 10.5.

The test procedure is carried out at room temperature of 25° C. by pipeting 5 ml of the sodium oleate solution into a 100-ml stoppered graduated cylinder followed by 0.5 ml of the LSD polymer solution. Contents of the cylinder are swirled, 10 ml of the hardness solution is added to the cylinder and enough demineralized water is added to make up the total volume of 30 ml. The cylinder is stoppered and then gently agitated by inverting it and returning it to its original upright position, which is repeated 20 times. At least one minute is allowed to elapse and then the contents are observed critically. If coarse agglomerates of calcium oleate coagulate and float on top, it is apparent that not enough of the lime soap dispersant has been used.

The test is continued by repeating above procedure using a fresh cylinder and increasing volume of the LSD polymer solution by 0.5 ml. The procedure is repeated in increments of 0.5 ml of the LSD polymer. As amount of the LSD polymer is increased, the coarse calcium oleate agglomerates will break down into smaller and smaller particles which will continue to float on the surface. The end point is reached when there are no longer any calcium oleate particles seen floating on the solution surface and the entire test solution appears milky white, which is an indication of total dispersion. The lime soap dispersion index (LSDI) can be calculated as follows:

$$LSDI = \frac{\text{0.025 (which is the wt. of sodium oleate in each cylinder)}}{\text{vol. of } LSD \text{ soln at the end point} \times 0.25/100}$$

The samples of acrylic acid and acrylamide homopolymers and acrylic acid-acrylamide copolymers of varying composition and molecular weight (Mw) were prepared and then tested, as described above, to determine the lime soap dispersion index, which is an indication of its effectiveness as a lime soap dispersant. The higher the LSDI the more effective is the material. The results are set forth in Table I below:

TABLE I

| Composition (Wt %) | | LSDI | LSDI | LSDI |
|---|---|---|---|---|
| AA | Am | (Mw 5,000) | (Mw 20,000) | (Mw 60,000) |
| 100 | 0 | 3.6* | 2.1 | 2.7 |
| 70 | 30 | 2.1 | 3.1* | 2.7 |
| 30 | 70 | 2.1 | 1.9 | 5.7* |
| 0 | 100 | 0.7 | 0.7 | 0.7 |

The above results indicate that in each molecular weight series, the LSDI goes through a maximum (*) at different and unique acrylic acid (AA) to acrylamide (Am) proportion The above results also unequivocally demonstrate the synergistic nature of the lime soap dispersing copolymers. Although acrylic acid homopolymer with molecular weight of 5,000 did have an LSDI of 3.6, which was the maximum for the Mw 5,000 series, however, homopolymer of acrylic acid of 20,000 molecular weight had an LSDI of 2.1 whereas 70/30 AA/Am copolymer had an LSDI of 3.1 which was the maximum for the Mw 20,000 series. The acrylic acid homopolymer of 60,000 molecular weight had an LSDI of 2.7 but a very high LSDI of 5.7 for 30/70 AA/Am copolymer, which was the maximum for the Mw 60,000 series.

In order to optimize composition of the lime soap dispersing copolymers, a series of additional copolymers of acrylic acid and acrylamide were prepared with molecular weight of 60,000. Compositional increments were reduced to 10% by weight to define more closely the optimum range of acrylic acid to acrylamide ratios for best lime soap dispersancy. The data for the homopolymers and copolymers that were tested and results in terms of LSDI obtained for 100% dispersion of lime soap aggregate, are set forth in Table II, below:

TABLE II

| Composition (Wt %) | | |
|---|---|---|
| AA | Am | LSDI (Mw 60,000) |
| 100 | 0 | 2.7 |
| 90 | 10 | 2.4 |
| 80 | 20 | 2.7 |
| 70 | 30 | 2.7 |
| 60 | 40 | 3.6 |
| 50 | 50 | 3.6 |
| 40 | 60 | 2.7 |
| 30 | 70 | 5.7 |
| 20 | 80 | 0.8 |
| 10 | 90 | 0.7 |
| 0 | 100 | 0.7 |

Results set forth in Table II demonstrate the effectiveness of lime soap dispersing copolymers having relative weight ratio of acrylic acid to acrylamide in the range of from 20 to 80, preferably 35 to 75. The most effective lime soap dispersant was a copolymer of 30% acrylic acid and 70% acrylamide with a molecular weight of 60,000.

In order to demonstrate criticality of the molecular weight on the lime dispersing property, a number of different homopolymers of acrylic acid and copolymers of acrylic acid and acrylamide were obtained and tested. In this group of polymers, an acrylic acid homopolymer of 5–6 million molecular weight (Mw) was tested for lime soap dispersing property pursuant to the procedure described herein. This homopolymer is known as Cyanamer P-250 and is available from American Cyanamid Company. This homopolymer yielded an LSD index of much less than 0.7, indicating little or no activity in terms of its lime soap dispersing property. A copolymer of acrylic acid and acrylamide was also tested for its lime soap dispersing function. This copolymer had molecular weight (Mw) of about 200,000 and is available from the American Cyanamide Company as Cyanamer P-26. This copolymer gave an LSD index of less than about 0.7, indicating very little activity in terms of its limer dispersing property.

In lines 30–40 of column 2, the Pye et al U.S. Pat. No. 3,275,561 describes that in order to obtain the desired lubricity, it is critical to employ in its invention high molecular weight acrylamide polymers, i.e., polymers characterized by a viscosity of at least 4 centipoises for a 0.5% by weight solution of the polymer in an aqueous 4% by weight sodium chloride solution adjusted to a H of 5 to 6 at a temperature of 25° C. This viscosity was measured with an Ostwald viscosimeter. Pye et al's acrylamide polymers are described as copolymers of acrylamide with up to 50 mole percent of acrylic or methacrylic acid or an alkali metal salt thereof.

The 30/70 copolymer of acrylic acid to acrylamide, with a molecular weight (Mw) of 60,000, shows superb lime dispersing property, as demonstrated above. The 30/70 is a weight ratio which corresponds to a mole ratio of 1/2.36. Viscosity of this copolymer was measured in the manner described by the Pye et al patent to show that the polymers suitable herein are not of a high molecular weight, as disclosed by the Pye et al patent and other prior art. Viscosity of the 30/70 copolymer was determined to be 1.15 centipoises, which is well below the minimum of 4 centipoises said to be suitable by the Pye et al patent.

The molecular weight given herein was measured by gel permeation chromatography of 0.4% tetrahydrofuran solution.

Preparation of the homopolymers and copolymers noted herein was carried out in a well known manner. The procedure involved initially dissolving 2 grams of sodium persulfate free radical initiator in about 25 ml of water. A flask was charged with 30 grams acrylic acid, 70 g of acrylamide, 0.5 grams of mercaptopropionic acid as molecular weight regulator, and 239 grams of water. The flask was swept with nitrogen and maintained under a slight positive pressure of nitrogen. The sodium persulfate solution was added to the flask in one portion and after several minutes, the mixture started to exotherm. When the exotherm subsided in about 2 to 10 minutes, the mixture was heated for 2 hours at reflux of about 100° C. Then, 1 ml of 50% hydrogen peroxide solution was added and the mixture was kept overnight at about 75° C. to decrease residual monomer. The copolymer was obtained as a viscous solution. Molecular weight (Mw) of the copolymer was about 60,000.

We claim:

1. Bar soap composition for personal use comprising at least one organic water-soluble surfactant selected from alkali metal salt of tallow/coconut soap in amount of 60–80 weight parts, 10–20 weight parts of a lime soap dispersant (LSD) selected from the group consisting of copolymers and water-soluble salts of said copolymers, said copolymers being copolymers of acrylic acid methacrylic acid, or mixtures thereof, and an acrylamide or mixtures of acrylamides, said copolymers having molecular weight (Mw) in the range of about 20,000 to 100,000 and contain 35 to 75% by weight of said acrylamide or a mixture thereof, and water to 100 weight parts of total composition, said acrylamide is selected from substituted and unsubstituted acrylamides defined by the following formula:

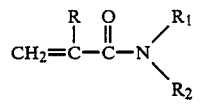

where R is either hydrogen or a methyl group and $R_1$ and $R_2$ are individually selected from hydrogen, alkyl groups of 1 to 2 carbon atoms, and alkylol groups of 1 to 2 carbon atoms, said water-soluble salts of said copolymers are selected from alkali metal sals, ammonium salts, and substituted ammonium salts, the relative ratio of surfactant to said lime soap dispersant is 100/1 to ½.

2. Bar soap composition for laundry use comprising at least one organic water-soluble surfactant selected from alkali metal salt of tallow soap in amount of 40–60 weight parts, 10–20 weight parts of sodium silicate, 5–20 weight parts of a lime soap dispersant (LSD) selected from the group consisting of copolymers and water-soluble salts of said copolymers, said copolymers being copolymers of acrylic acid, methacrylic acid, or mixtures thereof, and an acrylamide or mixtures of acrylamides, said copolymers having molecuar weight (Mw) in the range of about 20,000 to 100,000 and contain 35 to 75% by weight of said acrylamide or a mixture thereof, and water to 100 weight parts of total composition, said acrylamide is selected from substituted and unsubstituted acrylamides defined by the following formula:

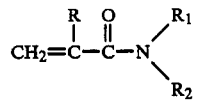

where R is either hydrogen or a methyl group and $R_1$ and $R_2$ are individually selected from hydrogen, alkyl groups of 1 to 2 carbon atoms, and alkylol groups of 1 to 2 carbon atoms, said water-soluble salts of said copolymers are selected from alkali metal salts, and substituted ammonium salts, the relative ratio of surfactant to said lime soap dispersant is 100/1 to ½.

3. Dry soap laundry powder composition comprising at least one organic water-soluble surfactant selected from alkali metal salt of tallow soap in amount of 60–80 weight parts, 10–15 weight parts of sodium silicate, 1–3 weight parts of sodium carboxymethyl cellulose, 10–20 weight parts of a lime soap dispersant (LSD) selected from the group consisting of copolymers and water-soluble salts of said copolymers, said copolymers being copolymers of acrylic acid, methacrylic acid, or mixtures thereof, and an acrylamide or mixtures of acrylamides, said copolymers having molecular weight (Mw) in the range of about 20,000 to 100,000 and contain 35 to 75% by weight of said acrylamide or a mixture thereof, and water to 100 weight parts of total composition, said acrylamide is selected from substituted and unsubstituted acrylamides defined by the following formula:

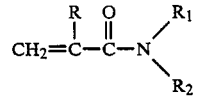

where R is either hydrogen or a methyl group and $R_1$ and $R_2$ are individually selected from hydrogen, alkyl groups of 1 to 2 carbon atoms, and alkylol groups of 1 to 2 carbon atoms, said water-soluble salts of said copolymers are selected from alkali metal salts, ammonium salts, and substituted ammonium salts, the relative ratio of surfactant to said lime soap dispersant is 100/1 to ½.

4. Liquid dishwashing detergent composition comprising at least one organic water-soluble surfactant selected from 20–45 weight parts anionic and or nonionic surfactant, 1–10 weight parts hydrotrope, 1–10 weight parts of mono or polyhydric water-miscible alcohol, 5–15 weight parts of a lime soap dispersant (LSD) selected from the group consisting of copolymers and water-soluble salts of said copolymers, said copolymers being copolymers of acrylic acid, methacrylic acid, or mixtures thereof, and an acrylamide or mixtures of acrylamides, said copolymers having molecular weight (Mw) in the range of about 20,000 to 100,000 and contain 35 to 75% by weight of said acrylamide or a mixture thereof, and water to 100 weight parts of total composition, said acrylamide is selected from substituted and unsubstituted acrylamides defined by the following formula:

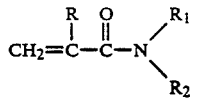

wherein R is either hydrogen or a methyl group and $R_1$ and $R_2$ are individually selected from hydrogen, alkyl groups of 1 to 2 carbon atoms, and alkylol groups of 1 to 2 carbon atoms, said water-soluble salts of said copolymers are selected from alkali metals salts, ammonium salts, and substituted ammonium salts, the relative ratio of surfactant to said lime soap ispersant is 100/1 to ½.

* * * * *